US008186967B2

(12) United States Patent
Kong

(10) Patent No.: US 8,186,967 B2
(45) Date of Patent: May 29, 2012

(54) FAIL-SAFE CONTROL METHOD FOR OIL PUMP CONTROL UNIT OF HYBRID VEHICLE

(75) Inventor: Seung Ki Kong, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 363 days.

(21) Appl. No.: 12/567,034

(22) Filed: Sep. 25, 2009

(65) Prior Publication Data

US 2010/0143156 A1 Jun. 10, 2010

(30) Foreign Application Priority Data

Dec. 5, 2008 (KR) ..... 10-2008-0123600

(51) Int. Cl.
*F04B 49/06* (2006.01)
*F04B 9/14* (2006.01)

(52) U.S. Cl. ..... 417/44.1; 417/374

(58) Field of Classification Search ..... 417/44.1, 417/374

See application file for complete search history.

(56) References Cited

U.S. PATENT DOCUMENTS

| | | | | |
|---|---|---|---|---|
| 6,878,083 | B2 * | 4/2005 | Guenther et al. | 475/127 |
| 2006/0149433 | A1 * | 7/2006 | Otsubo et al. | 701/29 |
| 2011/0269583 | A1 * | 11/2011 | Kawakami et al. | 474/28 |

FOREIGN PATENT DOCUMENTS

| | | | |
|---|---|---|---|
| JP | 2006-254628 | A | 9/2006 |
| JP | 2007-015679 | A | 1/2007 |
| JP | 2007-069788 | A | 3/2007 |
| KR | 10-2003-0047816 | A | 6/2003 |
| KR | 10-2005-0076769 | A | 7/2005 |

* cited by examiner

*Primary Examiner* — Charles Freay
(74) *Attorney, Agent, or Firm* — Edwards Wildman Palmer LLP; Peter F. Corless

(57) ABSTRACT

A fail-safe control method for an oil pump control unit of a hybrid vehicle directly connects an automatic transmission control unit and an oil pump control unit via a hard wire to control an oil pump driver in the event of a failure of the CAN communication line of the oil pump control. It enables the rotation speed of a motor of the electric oil pump to be controlled by a motor control unit (MCU) or a underdrive brake (UD_BRAKE) to be controlled in on/off mode or in slip mode by the automatic transmission control unit until a mechanical oil pump is driven, in the event of a failure of the oil pump control unit or the electric oil pump.

2 Claims, 6 Drawing Sheets

FAIL-SAFE CONTROL METHOD FOR OIL PUMP CONTROL UNIT OF HYBRID VEHICLE

CROSS-REFERENCE TO RELATED APPLICATION

This application claims under 35 U.S.C. §119(a) the benefit of Korean Patent Application No. 10-2008-0123600, filed Dec. 5, 2008, the entire contents of which are incorporated herein by reference.

BACKGROUND (a) Technical Field

The present disclosure relates to a fail-safe control method for an oil pump control unit of a hybrid vehicle. More particularly, it relates to a fail-safe control method, which can ensure driving performance by a fail-safe or limp-home control in the event of a failure of an electric oil pump for a hybrid vehicle, an oil pump control unit, or a CAN communication line.

(b) Background Art

In a hybrid vehicle, a mechanical oil pump mounted in the automatic transmission (ATM) can supply hydraulic pressure to the automatic transmission only when the vehicle is driven (automatic transmission input speed>600 rpm, for example).

An external electric oil pump (OP) mounted in the hybrid vehicle generates hydraulic pressure (e.g., 10.5 bar) in a hydraulic circuit (valve body) in the automatic transmission and in the engine clutch even in the event that an engine is stopped such as in electric vehicle (EV) mode, idle stop mode, etc.

In EV mode in which the hybrid vehicle is driven only by the electric motor, since the output torque of the electric motor is transmitted to an output shaft through the automatic transmission, it is necessary, when the engine is stopped, to apply a predetermined torque capacity to the automatic transmission by receiving the hydraulic pressure from the electric oil pump.

However, in the event that the engine of the hybrid vehicle is driven at a low speed (e.g., driven at less than about 600 rpm) or stopped, if a motor of the electric oil pump is off due to its failure or due to a failure of a CAN communication line or an oil pump control unit, the supply of hydraulic pressure to the automatic transmission and the engine clutch becomes zero or insufficient, and thus the output of the electric motor may not be transmitted to an output member. Consequently, it may be impossible to drive the vehicle, perform a fail-safe or limp-home control, and ensure desired driving performance.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to solve the above-described problems associated with prior art. Accordingly, the present invention provides a fail-safe control method for an oil pump control unit of a hybrid vehicle, which can ensure driving performance by a fail-safe or limp-home control in the event of a failure of the electric oil pump for a hybrid vehicle, an oil pump control unit (OPU) for a hybrid vehicle, or a CAN communication line.

For this purpose, in the event of a failure of the CAN communication line, a hard wire is alternatively used to directly control an automatic transmission control unit (TCU) and the oil pump control unit (OPU) with wire pins, or a motor control unit measures the rotation speed (Nmot) of an electric oil pump motor to control the electric oil pump motor, or the transmission control unit (TCU) controls an underdrive brake (UD_BRAKE) in on/off mode or in slip mode until a mechanical oil pump is driven, thus enabling a limp-home control.

In one aspect, the present invention provides a fail-safe control method for an oil pump control unit of a hybrid vehicle, the method comprising the steps of: (a) determining whether an oil pump system is off due to a failure of an oil pump control unit or an electric oil pump or whether a CAN communication line of the oil pump control unit is off; when the engine of the vehicle is driven at a predetermined speed (e.g., less than 600 rpm) or stopped (b) determining whether a hard wire is on or off, when the CAN communication line is off; (c) operating an oil pump driver by directly connecting the oil pump control unit to an automatic transmission control unit using the hard wire, when the hard wire is on in step (b), thus operating a motor of the electric oil pump; (d) controlling the oil pump driver itself by controlling the rotation speed of the motor of the electric oil pump through a motor control unit, when the hard wire is off in step (b); (e) operating the motor of the electric oil pump by controlling the rotation speed of the motor of the electric oil pump through the motor control unit, when the CAN communication line of the oil pump control unit is in a normal state and the CAN communication line of the automatic transmission control line is in a failure state at step (d); (f) operating the motor of the electric oil pump by driving the oil pump driver at a predetermined speed (e.g., 1st speed), when there is a failure in the CAN communication line of the oil pump driver at step (d); and (g) turning off the motor of the electric oil pump in the event of a failure of the oil pump driver or the motor of the electric oil pump, when the oil pump system is off.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
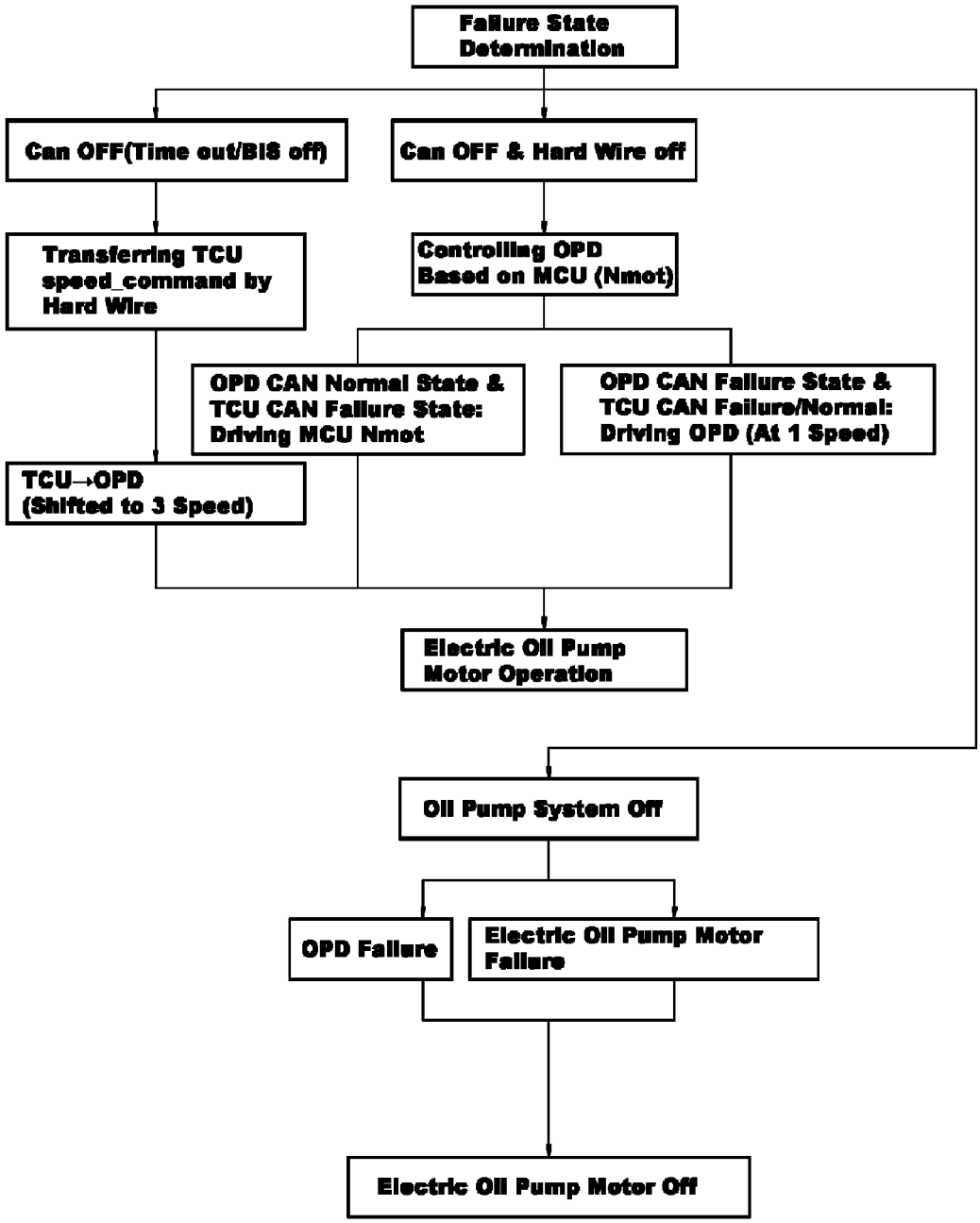
FIG. 1 is a schematic diagram illustrating a fail-safe control process for an oil pump control unit of a hybrid vehicle in accordance with the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The present invention aims at providing a fail-safe control method for an oil pump control unit of a hybrid vehicle, in which when the engine of the hybrid vehicle is driven at an automatic transmission input speed of less than a certain RPM value (e.g., 600 rpm) or stopped, in the event of a failure of an electric oil pump or an oil pump control unit (OPU) controlling the electric oil pump, the output of an electric motor is transmitted to an output member such that the torque limit (Torque_Limit) of a motor control unit (MCU) is limited to provide a normal vehicle control, a fail-safe control (safe control in the event of failure), or a limp-home control (minimum driving in the event of failure), the automatic transmission is driven by controlling a minimum driving torque (e.g., 5 to 10 km/h) and a creep torque, and an automatic transmission control unit (TCU) on/off controls an underdrive brake (UD_BRAKE) until a mechanical oil pump in the automatic transmission is driven, thus enabling a limp-home control.

Moreover, in the event of a failure in a CAN communication line of the oil pump control unit (OPU), the automatic transmission control unit (TCU) and the oil pump control unit (OPU) are directly connected via a hard wire, thus enabling transmission and reception of signals.

Figure 3:
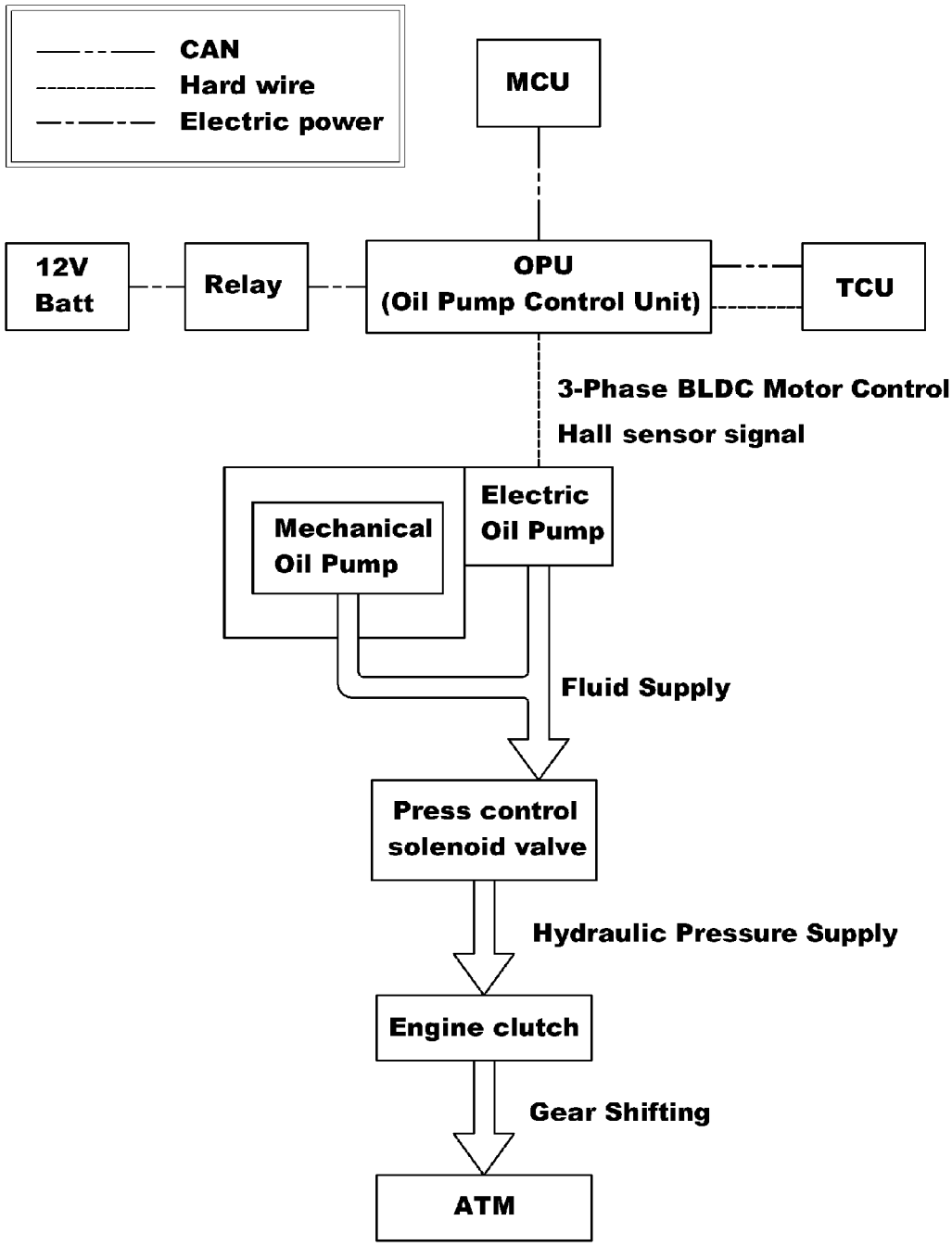
FIG. 3 is a system configuration diagram illustrating the operation of an external electric oil pump.
Figure 5:
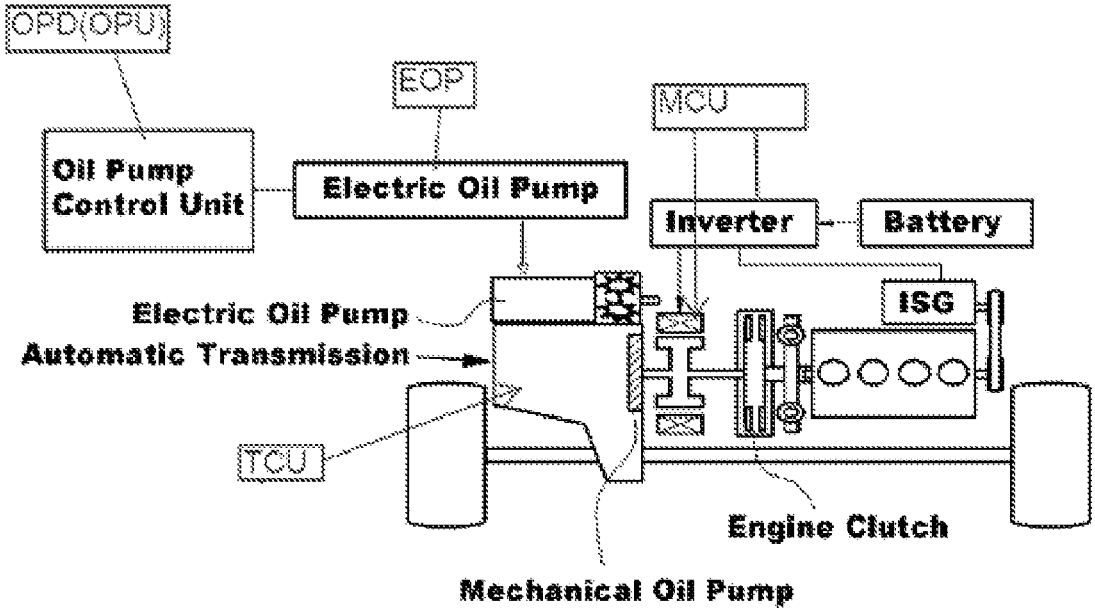
FIG. 5 is a schematic diagram illustrating a portion of a driving unit of a hybrid vehicle.
Figure 6:
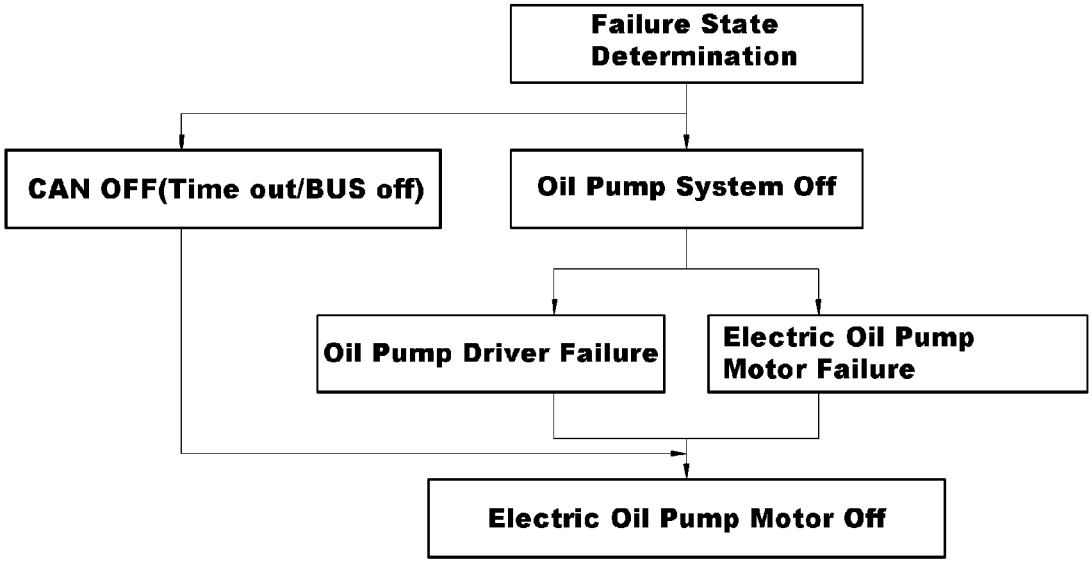
FIG. 6 is a schematic diagram illustrating a conventional fail-safe control.

FIG. 1 is a schematic diagram illustrating a fail-safe control process for an oil pump control unit of a hybrid vehicle in accordance with the present invention, and FIGS. 3 and 5 show a system configuration diagram illustrating the operation of an external electric oil pump.

Referring to FIGS. 3 and 5, an automatic transmission is equipped with a mechanical oil pump and an electric oil pump in a cooperative manner. The oil pumps are configured to supply oil to a press control solenoid valve which generates hydraulic pressures to control an engine clutch. The electric oil pump is controlled by an oil pump control unit (also referred to herein as "OPU") that is powered by a battery via a relay. The OPU is designed to communicate with a motor control unit (MCU) and a transmission control unit (TCU) via CAN communication lines. Further, the OPU and the electric oil pump are connected with each other via a hard wire. A hard wire connection also is provided between the TCU and the OPU.

When an engine of a hybrid vehicle is driven at less than a certain rpm value (e.g., 600 rpm) or stopped, it is determined, as shown in FIG. 1, whether there is a failure in an electric oil pump (OP), an oil pump control unit controlling the electric oil pump, or a CAN communication line of the oil pump control unit.

If it is determined that there is a failure of a CAN communication line and it is due to a time-out or bus-off, it is determined whether there is a failure in a hard wire.

In the event of a time-out or bus-off, the CAN communication line is in OFF state, but the hard wire is in ON state. Thus, an automatic transmission control unit controlling an automatic transmission (ATM) and an oil pump control unit are connected via the hard wire to transmit a speed command signal of the automatic transmission control unit (TCU) to an oil pump driver (OPD).

Then, the oil pump driver receiving the speed command signal is shifted to a certain speed stage (e.g., 3rd speed) to operate a motor of the electric oil pump.

Meanwhile, if it is determined that there is a failure in the hard wire as well as in the CAN communication of the oil pump control unit, the rotation speed (Nmot) of the motor is controlled through a motor control unit (MCU) for controlling the motor of the electric oil pump to control the oil pump driver (OPD) itself.

Here, the oil pump driver (OPD) for driving the electric oil pump is controlled as follows. If the CAN communication line of the oil pump driver (OPD) is in a normal state and the CAN communication line of the automatic transmission control unit in a failure state, the rotation speed (Nmot) of the motor is controlled by the motor control unit to operate the motor of the electric oil pump. Otherwise, if there is a failure in the CAN communication line of the oil pump driver (OPD), the oil pump driver (OPD) is not variably controlled, regardless of whether or not there is a failure in the CAN communication line of the automatic transmission control unit, but is driven at a certain speed (e.g., 1st speed), thus operating the motor of the electric oil pump.

Figure 2:
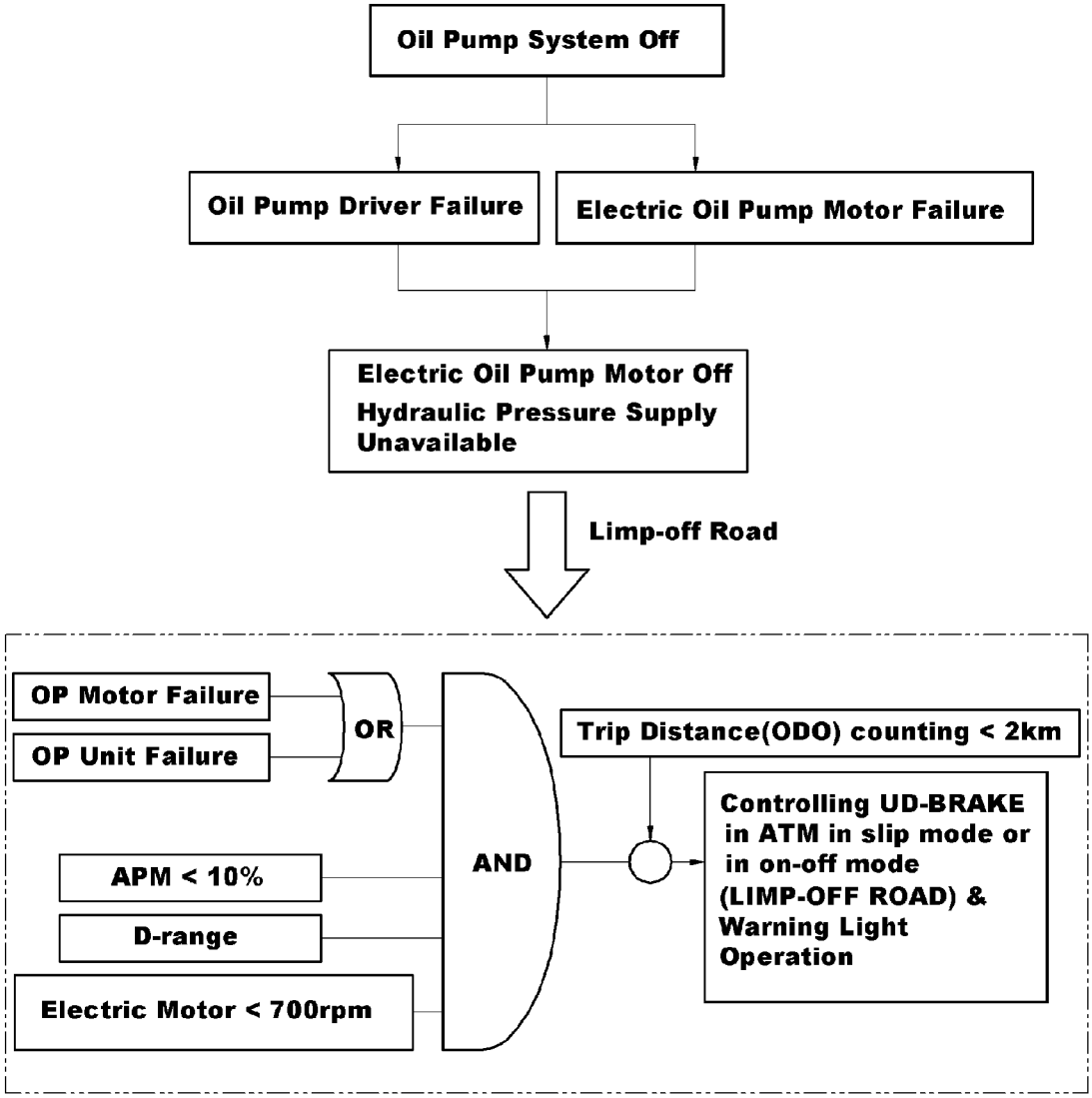
FIG. 2 is a schematic diagram illustrating fail-safe control conditions when an oil pump system is off in accordance with the present invention.

FIG. 2 is a schematic diagram illustrating fail-safe control conditions when an oil pump system is off in accordance with the present invention.

As shown in FIGS. 1 and 2, in the event of a failure of an oil pump system such as the electric oil pump and the oil pump control unit, the oil pump driver (OPD) is in a failure state or the motor of the electric oil pump is in a failure state, and thus the motor of the electric oil pump is turned off. As a result, the electric oil pump cannot supply hydraulic pressure to the automatic transmission and an engine clutch. The automatic transmission control unit then drives an electric motor to on/off control an underdrive brake (UD_BRAKE) of the automatic transmission until a mechanical oil pump in the automatic transmission is driven, or opens the engine clutch to provide a limp-off road. Accordingly, in the event of a failure of the oil pump driver or the oil pump itself, the minimum driving of the vehicle (within e.g., 5 to 10 km/h) can be achieved, and the torque of the electric motor is limited to protect the automatic transmission.

Figure 4:
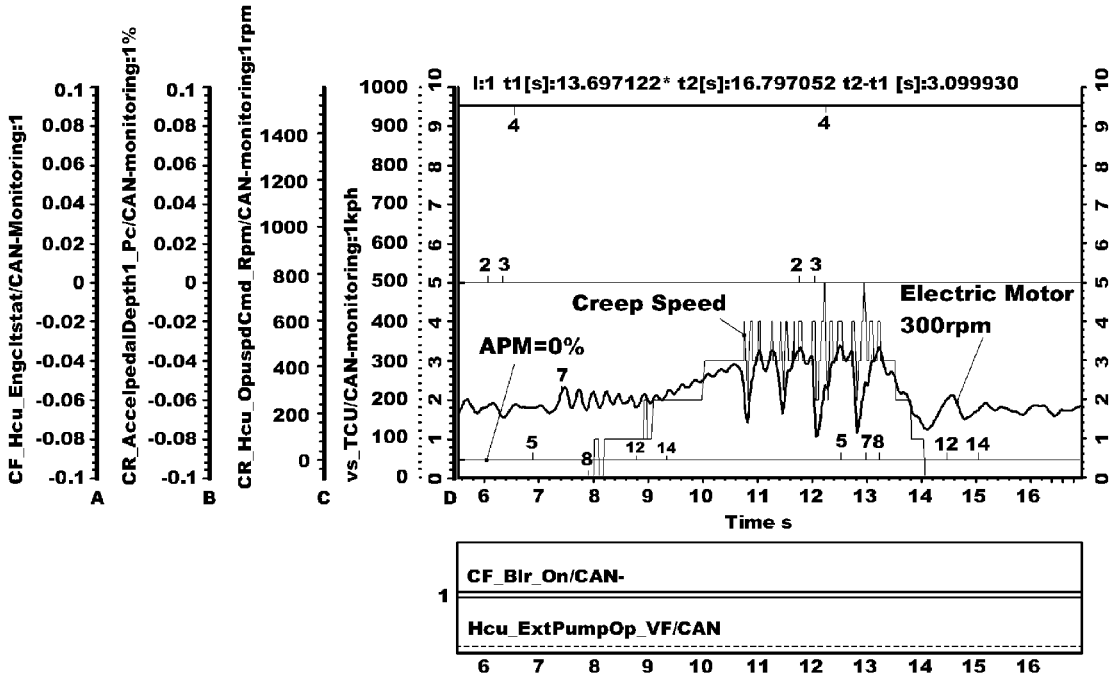
FIG. 4 is a graph showing test results of a limp-off road in accordance with the present invention.

FIG. 4 is a graph showing test results of a limp-off road in accordance with the present invention.

The test was performed to determine whether the automatic transmission control unit can control the UD_BRAKE in on/off mode or in slip mode while satisfying the following conditions in order to protect the automatic transmission.

Condition 1: The motor of the electric oil pump or the oil pump control unit is in a failure state.

Condition 2: Accelerator pedal module (APM) is less than 10%.

Condition 3: The automatic transmission is in a drive range.

Condition 4: The rotation speed of the electric motor is less than 700 rpm.

The trip distance (ODO) was limited to less than 2 km to ensure the durability of the automatic transmission while satisfying the above conditions 1 to 4 and, as a result, it was confirmed that the vehicle could be driven while controlling the UD_BRAKE in the automatic transmission (ATM) in on/off mode or in slip mode and operating warning lights.

Among others, as shown in FIG. 4, when an accelerator pedal module (APM) was 0%, the vehicle could be driven at a creep speed of about 6 km/h by turning on the electric motor and controlling the UD_BRAKE. Moreover, if the rotation speed of the electric motor was increased by limiting the accelerator pedal module (APM) to less than 10% to protect the automatic transmission, the vehicle could be driven at about 20 km/h.

As described above, according to the fail-safe control method for the oil pump control unit of a hybrid vehicle, in the event of a failure of the CAN communication line of the oil pump control unit, the automatic transmission control unit (ATM) and the oil pump control unit (OPU) are directly connected via a hard wire to control the oil pump driver (OPD), thus enabling the vehicle to be normally driven.

Moreover, in the event of a failure of the oil pump control unit or the electric oil pump, the rotation speed of the motor of the electric oil pump is controlled by the motor control unit (MCU), or the underdrive brake (UD_BRAKE) is controlled in on/off mode or slip mode by the automatic transmission control unit until the mechanical oil pump is driven, thus enabling the vehicle to be driven in a limp-home mode.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A fail-safe control method for an oil pump control unit of a hybrid vehicle, the method comprising the steps of:

(a) determining whether an oil pump system is off due to a failure of an oil pump control unit or an electric oil pump or whether a CAN communication line of the oil pump control unit is off, when the engine of the vehicle is driven at a predetermined speed of less than a certain RPM value or stopped;

(b) determining whether a hard wire is on or off, when the CAN communication line is off;

(c) operating an oil pump driver by directly connecting the oil pump control unit to an automatic transmission control unit using the hard wire, when the hard wire is on in step (b), thus operating a motor of the electric oil pump;

(d) controlling the oil pump driver itself by controlling the rotation speed of the motor of the electric oil pump through a motor control unit, when the hard wire is off in step (b);

(e) operating the motor of the electric oil pump by controlling the rotation speed of the motor of the electric oil pump through the motor control unit, when the CAN communication line of the oil pump control unit is in a normal state and a CAN communication line of an automatic transmission control line is in a failure state at step (d);

(f) operating the motor of the electric oil pump by driving the oil pump driver at a predetermined speed, when there is a failure in a CAN communication line of the oil pump driver at step (d); and (g) turning off the motor of the electric oil pump in the event of a failure of the oil pump driver or the motor of the electric oil pump, when the oil pump system is off.

2. The method of claim 1, wherein at step (g), if an accelerator pedal module has an operating ratio of less than 10%, if the rotation speed of an electric motor is less than 700 rpm, and if the automatic transmission is in a drive range, the transmission control unit controls an underdrive brake (UD_BRAKE) in on/off mode or in slip mode until a mechanical oil pump is driven.

* * * * *